US009534408B2

(12) United States Patent
Osterman et al.

(10) Patent No.: US 9,534,408 B2
(45) Date of Patent: Jan. 3, 2017

(54) SYSTEM AND METHOD FOR GENERATING WAVES IN MULTIPLE DIRECTIONS

(75) Inventors: Ross Alan Osterman, Winter Park, FL (US); Justin Michael Schwartz, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 1293 days.

(21) Appl. No.: 13/083,259

(22) Filed: Apr. 8, 2011

(65) Prior Publication Data

US 2012/0255112 A1 Oct. 11, 2012

(51) Int. Cl.

| | |
|---|---|
| ***A47K 3/10*** | (2006.01) |
| ***E04H 4/00*** | (2006.01) |
| *A63B 69/12* | (2006.01) |

(52) U.S. Cl.

CPC ..... *E04H 4/0006* (2013.01); *A63B 69/125* (2013.01)

(58) Field of Classification Search

USPC ..... 4/491; 405/79, 80

See application file for complete search history.

(56) References Cited

U.S. PATENT DOCUMENTS

| | | | | |
|---|---|---|---|---|
| 3,350,724 | A * | 11/1967 | Leigh | 4/491 |
| 3,635,448 | A * | 1/1972 | Okada | B44C 5/00 366/314 |
| 4,062,192 | A * | 12/1977 | Biewer | E04H 4/0006 4/491 |
| 4,692,949 | A * | 9/1987 | Dunn | 4/491 |
| 4,999,860 | A * | 3/1991 | Chutter et al. | 4/491 |
| 2007/0081861 | A1 | 4/2007 | Goble | |
| 2008/0282458 | A1* | 11/2008 | Carnahan et al. | 4/491 |

FOREIGN PATENT DOCUMENTS

| | | |
|---|---|---|
| AU | 558270 | 1/1987 |
| AU | 2003100257 | 4/2003 |
| CN | 2459397 Y | 11/2001 |
| ES | 2268933 | 3/2007 |
| JP | 53-63051 | 6/1978 |
| JP | 3-29676 | 2/1991 |

(Continued)

OTHER PUBLICATIONS

International Search Report and the Written Opinion of the International Searching Authority, PCT Application No. PCT/US2012/031266 dated Sep. 28, 2012.

(Continued)

*Primary Examiner* — Lauren Crane
(74) *Attorney, Agent, or Firm* — Fletcher Yoder, P.C.

(57) ABSTRACT

Present embodiments are directed to a system and method for generating waves in multiple directions. Present embodiments may include a wave generation mechanism configured to be positioned centrally within a container filled with water that is sufficiently sized to facilitate recreational activities for patrons within the container. The wave generation mechanism may include at least one actuator configured to activate at least one water-displacement medium to displace the water such that waves are propagated through the water, and a directional feature configured to direct the waves away from the wave generation mechanism after activation of the actuator such that the waves are propagated outward from the wave generation mechanism in multiple directions.

20 Claims, 7 Drawing Sheets

(56) References Cited

FOREIGN PATENT DOCUMENTS

| | | |
|---|---|---|
| JP | 03-73172 | 7/1991 |
| JP | 07-008866 | 1/1995 |
| SU | 108477 | 1/1957 |
| WO | 02086257 | 10/2002 |
| WO | 2006060866 | 6/2006 |

OTHER PUBLICATIONS

CN Office Action Mailed May 18, 2015.
RU 2013149868 Decision on Grant mailed Apr. 13, 2016.
JP Office Action dated Jun. 3, 2015, 10 Pages.

* cited by examiner

SYSTEM AND METHOD FOR GENERATING WAVES IN MULTIPLE DIRECTIONS

FIELD OF DISCLOSURE

The present disclosure relates generally to the field of amusement parks. More specifically, embodiments of the present disclosure relate to methods and equipment utilized to generate waves that are directed in multiple directions from a wave generator that is substantially or completely encompassed by a perimeter of a wave pool.

BACKGROUND

Water parks have grown in popularity throughout the world in recent years. A water park is a type of amusement park that incorporates water features and rides, such as water slides, spray areas, lazy rivers, swimming pools, and other recreational bathing and swimming environments. Water parks may include artificial imitations of nature. For example, many water parks include artificial rivers and rides that simulate river rapids or waterfalls. As another example, water parks may include one or more wave pools that function as an artificial ocean environment. A wave pool may be described as a sanitized and controlled version of the natural surf and beach of an ocean shore.

Wave pools may be utilized to provide guests of a water park with an artificial environment for surfing, body boarding, or the like. Further, a wave pool may be provided in which guests can swim or merely lounge and enjoy the waves passing through the water. In order to provide an appropriate setting for a variety of guest activities, different types of waves may be desired. For example, large or powerful waves may be preferable for surfing activities and smaller waves may be preferable for swimming activities. Accordingly, a water park may provide different wave pools for different activities. Similarly, a water park may provide different types of waves in the same wave pool at different times to provide guests with a variety of experiences.

DRAWINGS

These and other features, aspects, and advantages of the present invention will become better understood when the following detailed description is read with reference to the accompanying drawings in which like characters represent like parts throughout the drawings, wherein.

Figure 5:
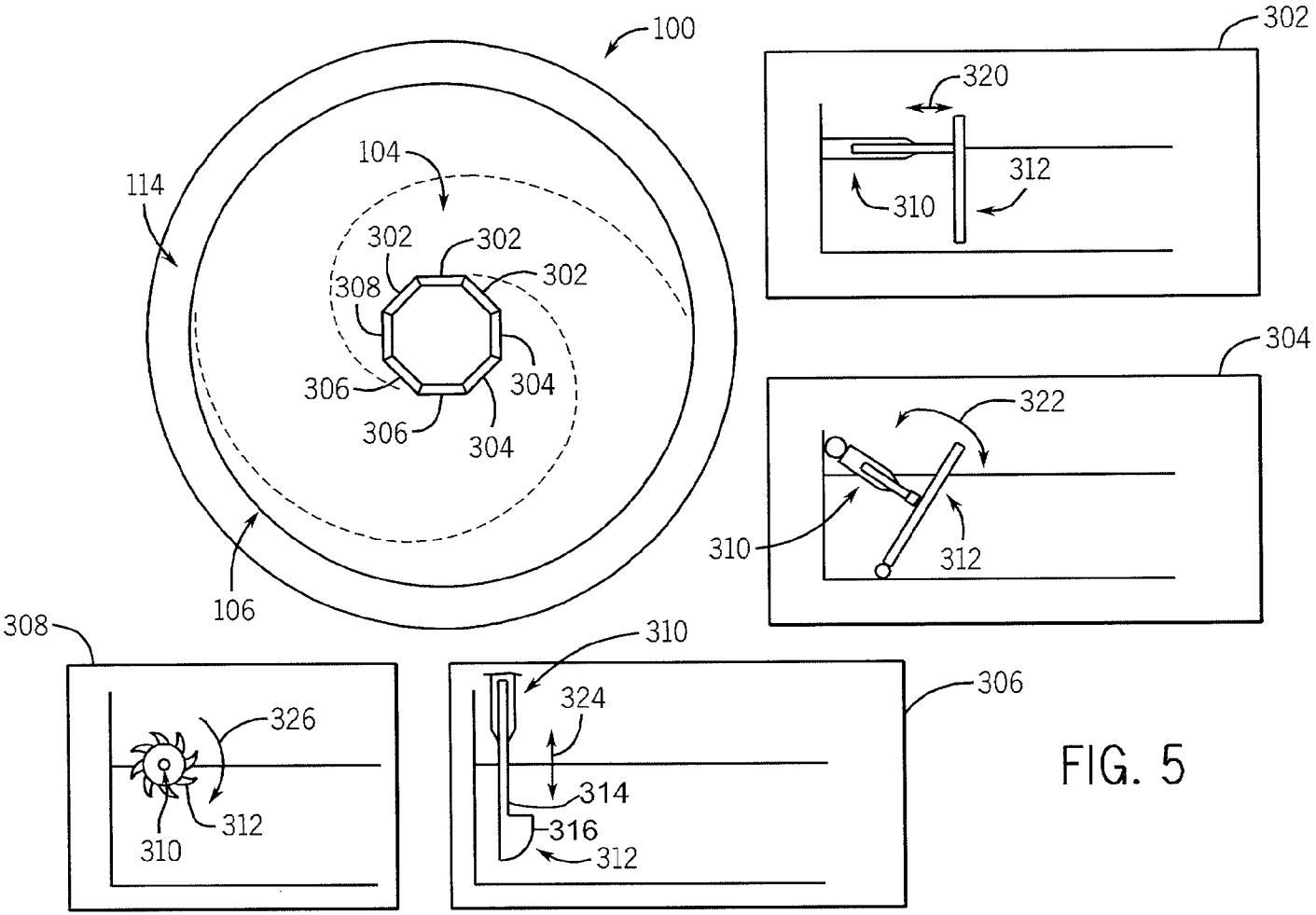
Figure 6:
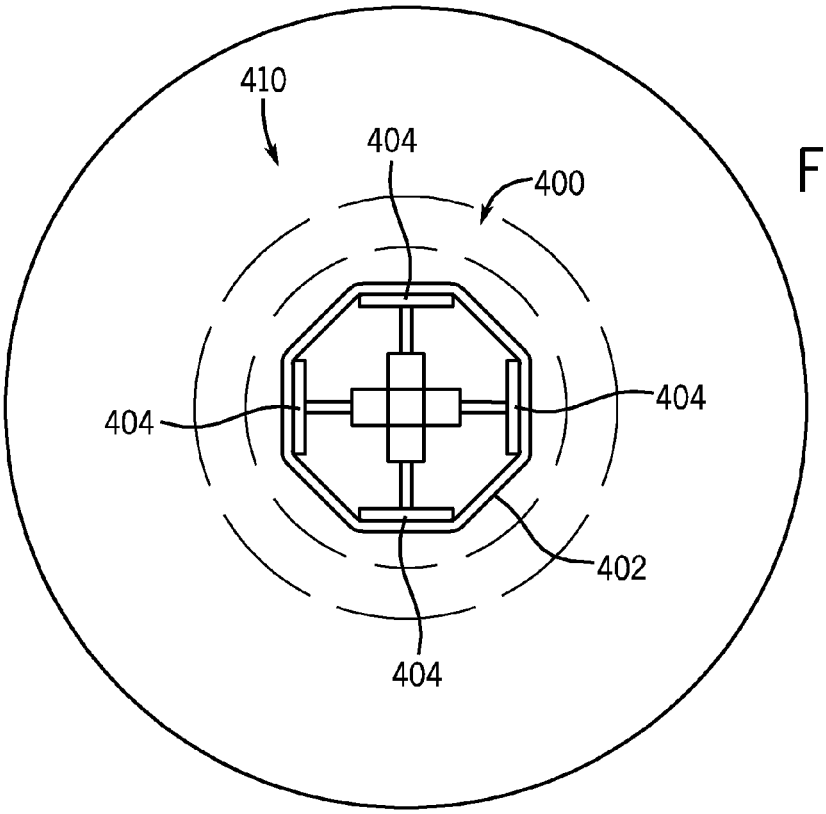
Figure 7:
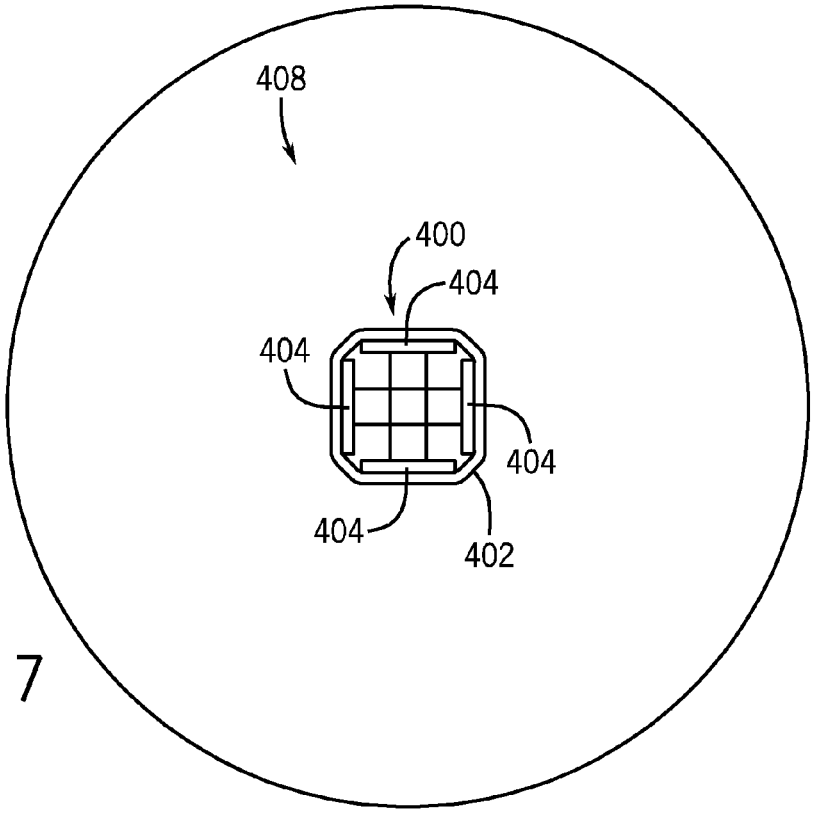
Figure 8:
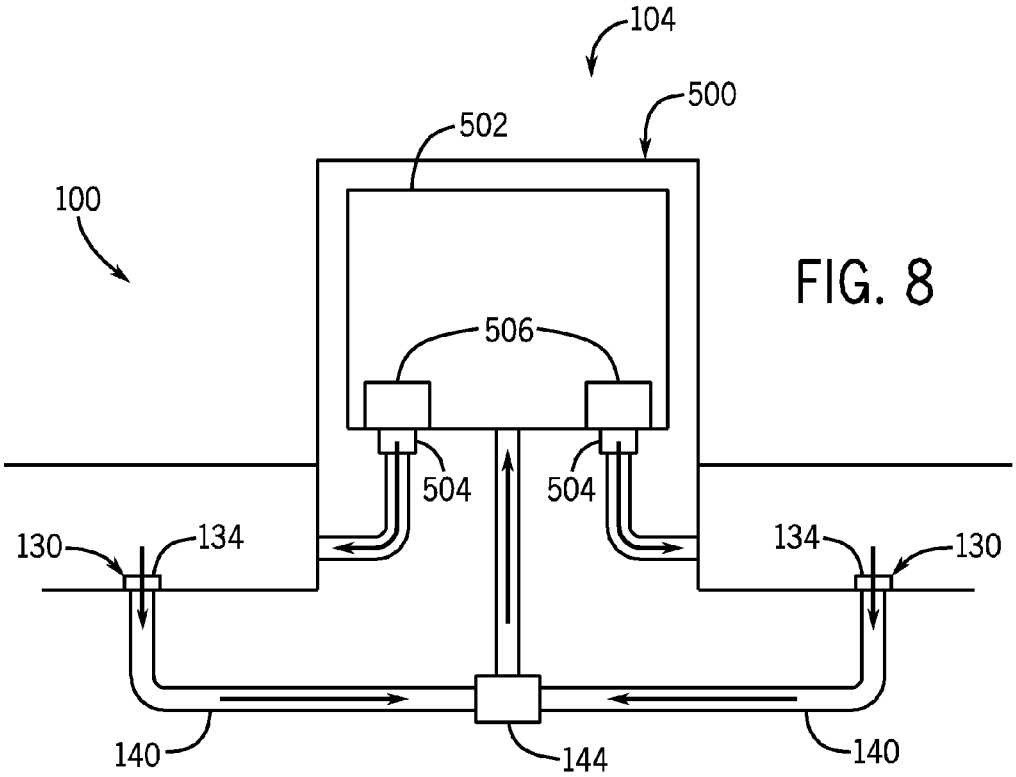
Figure 9:
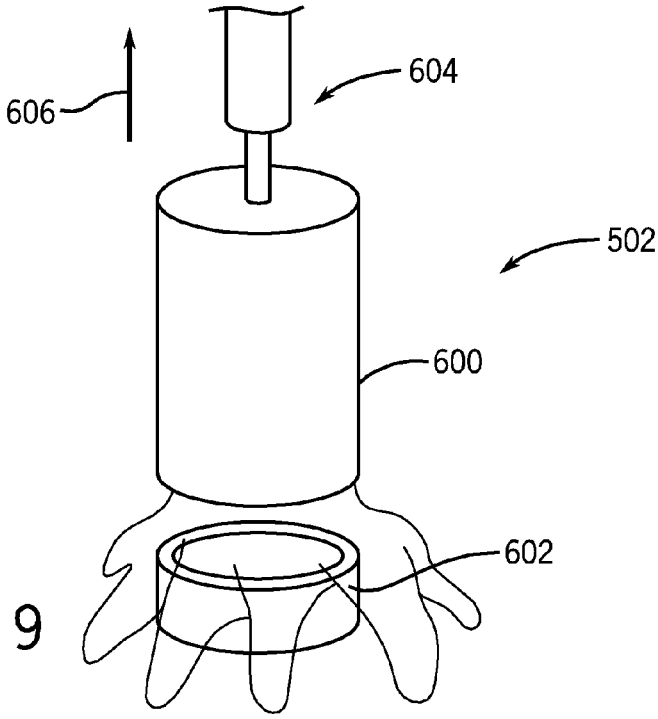
Figure 10:
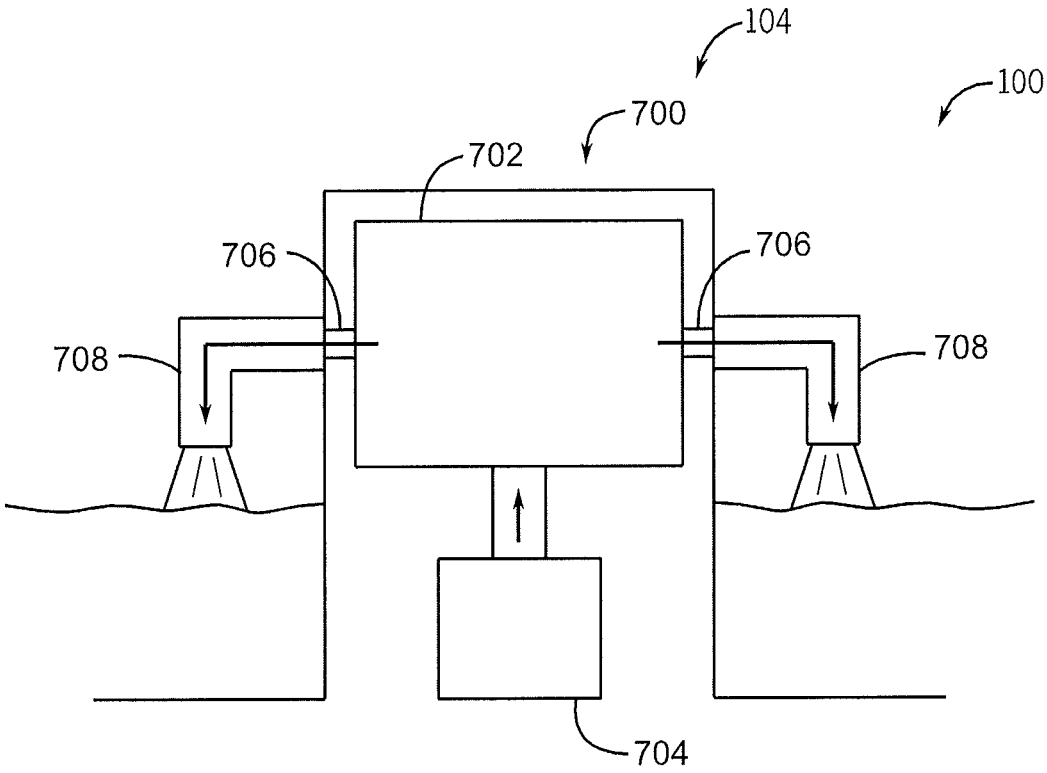

FIG. 5 includes a schematic plan view of a wave pool and side views of plunger systems utilized by a wave generation mechanism of the wave pool in accordance with present techniques;

FIG. 6 is an overhead view of a plurality of plunger systems in an expanded condition, wherein plungers of the plunger systems are coupled together via an expandable sheet in accordance with present techniques;

FIG. 7 is an overhead view of the plurality of plunger systems of FIG. 6 in a contracted condition, wherein plungers of the plunger systems are coupled together via an expandable sheet in accordance with present techniques;

FIG. 8 is a schematic cross-sectional view of a wave pool including a water dump system in accordance with present techniques;

FIG. 9 is a perspective view of a water dump system in accordance with present techniques; and FIG. 10 is a schematic cross-sectional view of a wave pool including a air blast system in accordance with present techniques;

DETAILED DESCRIPTION

The present disclosure relates generally to a wave pool that can be roughly circular in configuration, allowing water park patrons or guests to access waves at locations all around or substantially all around a perimeter of the wave pool. More specifically, embodiments of the present disclosure are directed to methods and equipment for providing waves in a wave pool from a location within the perimeter of the wave pool such that the waves propagate outwardly in multiple directions to a shoreline of the wave pool. Indeed, in accordance with present embodiments waves can be generated from a wave generation mechanism located at or near a center of the wave pool such that the waves expand outward 360 degrees or in multiple directions around the wave pool. Wave pools in accordance with present embodiments may provide a visually appealing and unique experience for water park patrons or guests. Different waves may be produced in different directions from the wave generation mechanism such that guests can move around the encompassing shore to preferred areas. Further, present embodiments may enable guests to swim completely around the wave generation mechanism. Additionally, the wave generation mechanism may coordinate wave generation in different directions to form unique wave patterns (e.g., a spiral wave) throughout the wave pool.

Figure 1:
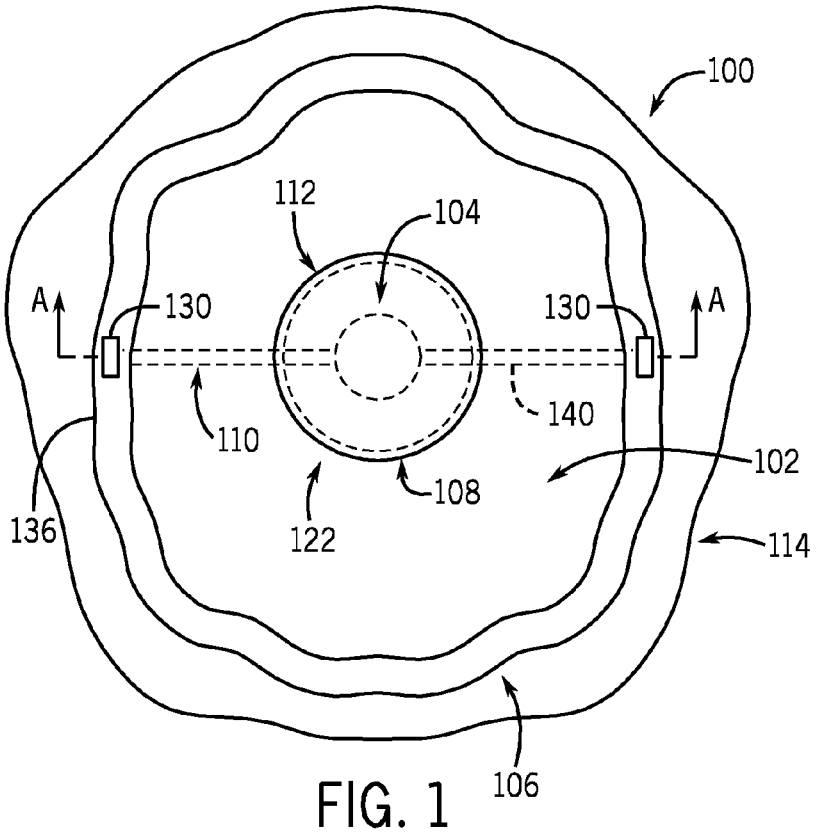
FIG. 1 is a schematic plan view of a wave pool in accordance with present techniques.
Figure 2:
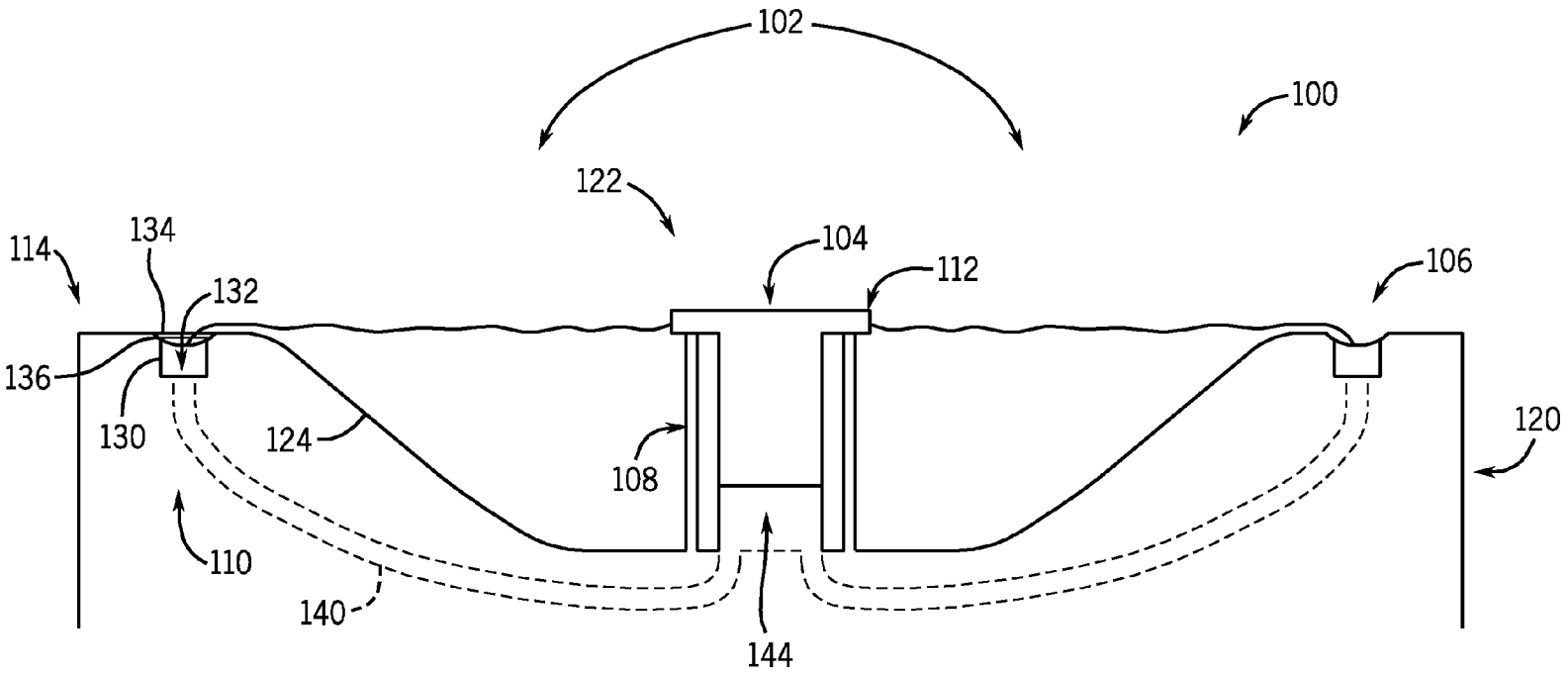
FIG. 2 is a schematic cross-sectional view of the wave pool of FIG. 1 in accordance with present techniques.

Turning to the figures, FIG. 1 is a schematic plan view of a wave pool 100 in accordance with present embodiments. In the illustrated embodiment, the wave pool 100 includes a pool area 102, a wave generation mechanism 104 positioned within a perimeter 106 of the wave pool 100, a porous barrier 108 surrounding the wave generation mechanism 104, a water gathering system 110, a platform 112 that is integrated with the wave generation mechanism 104 and extends over the porous barrier 108, and a shore or beach area 114. The wave pool 100 is also illustrated in FIG. 2, which provides a schematic cross-sectional view of the wave pool 100 along line A-A. The wave pool 100 of FIGS. 1 and 2 is representative of one embodiment of the present disclosure. Indeed, in other embodiments of the present disclosure, various aspects of the wave pool 100 illustrated in FIGS. 1 and 2 may not be included, may be arranged differently, or may include different characteristics. For example, in some embodiments, the wave pool 100 does not include the water gathering system 110 or the platform 112.

The pool area 102 is generally formed by a container 120 (e.g., a concrete-lined excavation) that is filled with water. The water surrounds the wave generation mechanism 104 and other features (e.g., the platform 112), which may cumulatively form an island 122. In the illustrated embodiment, the container 120 includes a bottom 124 that gradually slopes upward from a substantially central location toward the perimeter 106. This gradual sloping provides a shoreline for the wave pool 100 that imitates a natural beach area. In some embodiments, the slope may vary in different areas of the container 120 such that different areas along the perimeter 106 provide a variety of experiences for patrons. For example, different types of waves may be provided at different points along the perimeter 106 based on the nature of the slope proximate such points. Further, in some embodiments, portions of the container 120 along the perimeter 106 may form a perpendicular or substantially perpendicular wall.

The wave generation mechanism 104 generates waves by initiating wave energy (e.g., displacing or pushing) the water in the wave pool 100, which causes the water molecules to push (e.g., lift) other water molecules such that a wave propagates through the water toward the shore 114. A swell of the water forms as a wave passes through the water. In accordance with present embodiments, the wave generation mechanism 104 may generate waves by one of several methods or a combination of methods that may utilize various different displacement mediums (e.g., solid features, water, or air). Specifically, for example, water waves may be generated by displacing the water with pressurized air, pumped water, paddles, plungers, a volume of water dumped into the wave pool 100, or the like. Further, various different mechanisms may be utilized together to generate waves. Indeed, a combination of such mechanisms may enable generation of a specific type of wave. The manner in which the water is displaced or pushed by the wave generation mechanism 104 causes certain wave characteristics. Further, as a wave approaches the shore 114, the wave may change or combine with other waves. For example, the wave may slow and become laterally compressed because of changes in the container 120 (e.g., changes in depth). However, since the wave must essentially carry the same energy, it becomes higher or taller, which may eventually cause the wave to break. The slope of the bottom 124 impacts certain aspects of this wave formation and/or breaking process such that wave characteristics vary depending on the slope. Thus, present embodiments may coordinate features of the wave generation mechanism 104 with aspects of the bottom 124 or other characteristics of the container 120 to provide a variety of wave types.

Figure 3:
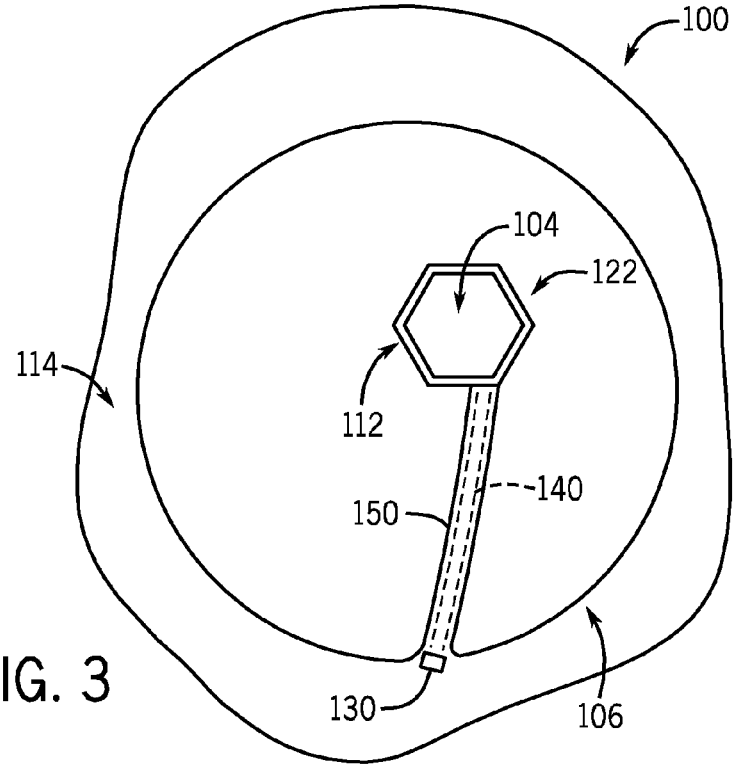
FIG. 3 is a schematic plan view of a wave pool including polygonal island and a walkway or barrier in accordance with present techniques.

The wave generation mechanism 104 may be located above and/or below a waterline or shoreline of the wave pool. The porous barrier 108 (e.g., a slotted wall or a barrier with an open grid pattern) may allow waves to pass through from the wave generation mechanism 104 while blocking patrons from accessing the wave generation mechanism 104. In some embodiments, the wave generation mechanism 104 has a polygonal shape or a displacement device of the wave generation mechanism includes a polygonal shape. For example, the wave generation mechanism 104 may include a single plunger with contact surfaces (e.g., bevels) arranged in a polygon that direct waves away from each side of the plunger upon being dropped into the water. In another embodiment, the wave generation mechanism 104 may include a plurality of wave generating devices arranged such that they form a polygon. Such polygonal configurations of the wave generation mechanism 104 may correspond to the island 122 being generally polygonal in shape, as illustrated in FIG. 3. In other embodiments, the wave generation mechanism 104 and the island 122 may be generally round. Different configurations of the wave generation mechanism 104 and/or the container 120 may facilitate generation of waves with different sizes and intensities along different areas of the perimeter 106 (or the beach area) of the wave pool 100. As illustrated by FIG. 3, in some embodiments, the wave generation mechanism 104 may be positioned closer to one part of the perimeter 106 than other parts of the perimeter 106 such that it is less centralized and different types of waves will impact the different areas of the perimeter 106 based on proximity to the wave generation mechanism 104.

In some embodiments, the wave generation mechanism 104 receives or accumulates water from the pool area 102 for use as a displacement medium. Indeed, at least a portion of the water utilized for wave generation may be acquired from various locations in the pool area 102. In other embodiments, water may be returned to the island 122 from the perimeter 106 to assist in creating certain wave characteristics (e.g., by reducing interference from waves bouncing off the edges of the container 120) or for other reasons (e.g., water supply for water cannons, waterfalls, or spray areas). In embodiments wherein water is moved to the island 122 or to the wave generation mechanism 104 from the pool area 102, the water gathering system 110 may be employed. Specifically, in the embodiment illustrated in FIGS. 1 and 2, the wave pool 100 includes water drains 130 that are configured to receive water at locations around the perimeter 106. In other embodiments, the water drains 130 may be located in different areas. Specifically, in the illustrated embodiment, the water drains 130 include openings 132 with gratings 134 positioned over them, wherein the water drains 130 are located in a groove or channel 136 around the perimeter 106. The channel 136 may function to direct water toward the water drains 130. In some embodiments, the gratings 134 may cover the entire channel 136 to filter out large particles (e.g., trash) and prevent patrons from stepping in the channel 136. These water drains 130, channels 136, and so forth are components of the water gathering system 110. In other embodiments, different components and arrangements may be utilized.

The water drains 130 gather water and drain into transport features 140 (e.g., piping or canals), which are also components of the water gathering system 110. The transport features facilitate transport (e.g., via gravity) of the water that has been gathered by the water drains 130 to the wave generation mechanism 104 or other features of the island 122. Traditional wave pools may include a water-collection reservoir that flows along the surface from an edge of the wave pool to an area behind or beside a wave generator. In the illustrated embodiment, the transport features 140 include the channel 136 that extends around the perimeter 106 and a pair of pipes that run underneath the bottom 124 of the container 120 to a pumping system 144 of the wave generation mechanism 104. In other embodiments, the transport features 140 may be arranged differently. For example, in one embodiment, each water drain 130 may drain directly into piping that transports drained water into the pumping system 144. In another embodiment, the water drains 130 are positioned around the wave pool 100 and drain to a gathering location that is connected to a single transport feature 140 that extends from the gathering location to the wave generation mechanism 104 or the island 122 and facilitates water flow thereto. The pumping system 144 operates to prepare the gathered water for wave generation. For example, the pumping system 144 may pump water out from the wave generation mechanism 104 in a jet stream, pump the water into a containment vessel of the wave generation mechanism 104 for release into the pool area 102, or both.

In some embodiments, as illustrated in FIG. 3, the wave pool 100 may include a structure 150 (e.g., a barrier, a walkway, or a bridge) that extends from the shore 114 to the platform 112. In the illustrated embodiment, the structure 150 includes a walking path that enables patrons to walk from the shore 114 to the platform 112 to participate in recreation on the platform 112. Indeed, the platform 112 may be designed to imitate a natural island by including vegetation, a shore-like area, rock structures, and so forth. The structure 150 may also enable maintenance workers to easily access the wave generation mechanism 104. In one embodiment, the structure 150 houses one or more of the transport features 140. For example, the structure 150 may include a barrier that extends from the water surface to the bottom 124 and the structure 150 may include piping or a channel that extends from a gathering point (e.g., one of the water drains 130) to the wave generation mechanism 104 to facilitate supplying the wave generation mechanism 104 or otherwise moving the water from areas around the perimeter 106 to the island 122. In one embodiment, the structure 150 may not extend all the way to the bottom 124 such that patrons can swim under the structure 150.

Figure 4:
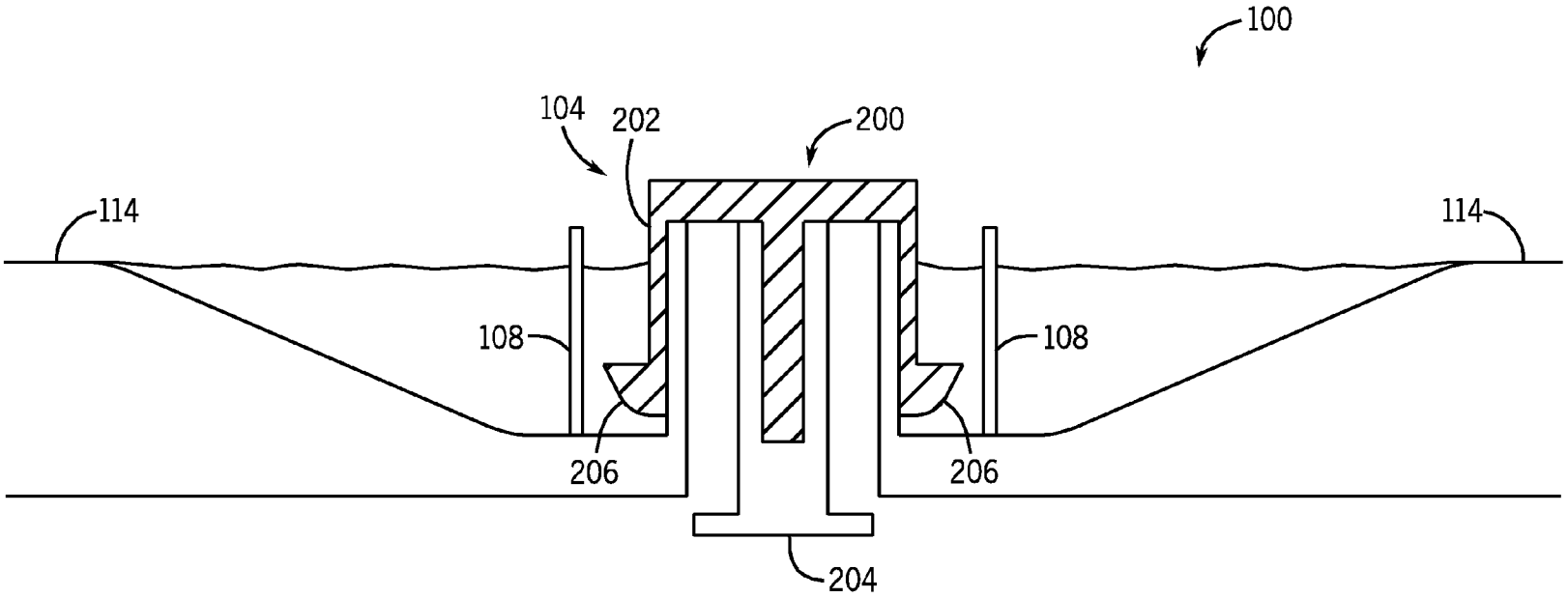
FIG. 4 is a schematic cross-sectional view of a wave pool including a plunger system in accordance with present techniques.

FIG. 4 is a schematic cross-sectional view of the wave pool 100 wherein the wave generation mechanism 104 comprises a plunger system 200 configured to generate waves in multiple directions in the wave pool 100. The plunger system 200 includes a plunger 202 for a displacement device and an actuator 204. In operation, the plunger 202 is pressed or dropped into the water. The impact of the plunger 202 in the water generates a wave that expands away from the plunger 202 in multiple directions (e.g., in all directions) toward the surrounding shore 114. Impact or contact surfaces of the plunger 202 (e.g., angled faces) may cause certain wave characteristics. Indeed, certain surface features of the plunger 202 function as directional features that direct generated waves in a certain direction. The actuator 204 may include motors (e.g., hydraulically driven motors or pneumatically driven motors) that are configured to repeatedly lift and drop (or press) the plunger 202 into the water to generate waves.

The plunger 202 may have a polygonal or round cross-section. In the illustrated embodiment, the plunger 202 includes contact features or impacting elements 206 (e.g., ledges with beveled faces) around the perimeter of the plunger 202 that facilitate wave generation. These impacting elements 206 also serve as directional features that guide waves in a particular direction. The plunger 202 may have different impacting elements 206 with different features on different sides such that various types of waves are generated by each side or such that waves are generated at different times based on the same actuation of the plunger 202. In one embodiment, the plunger 202 may be segmented. Similarly, a plurality of plungers may be utilized around the wave generation mechanism 104 to generate different types of waves in different directions. Specifically, the plunger 202 or a plurality of plungers may impact the water non-uniformly such that interesting wave patterns are generated and may extend out 360 degrees. For example, in one embodiment, the impacting elements 206 may correspond to a single beveled face that spirals around the perimeter of the plunger 202 at an angle or at changing angles such that different portions of the beveled face sequentially impact the water upon actuation of the plunger 202 and create a spiral wave pattern. As another example, the impacting elements 206 may include a plurality of angled or contoured faces of a single plunger or multiple plungers arranged at varying heights such that when the single plunger or the multiple plungers are directed into water, different impacting elements contact the water at different times. This may facilitate coordination of wave generation by the plunger in different directions such that patterns of waves can be formed. For example, various waves may be generated and different times and in different directions to produce a spiral wave in the wave pool 100. In another embodiment, a plunger may be maneuvered (e.g., driven into the water at varying times at varying angles) in the water to generate an uneven wave. Specifically, for example, a plunger may be moved vertically into and out of the water while pitching and/or rolling to generate certain wave characteristics.

In some embodiments, the wave generation mechanism 104 includes a plurality of plungers that are arranged together such that they face outward from the wave generation mechanism 104 toward the shore 114, which may completely surround the wave generation mechanism 104, as illustrated in FIG. 5. Such plungers may be driven linearly or by a linkage system. For example, a plurality of plunger systems may be arranged to form a perimeter of the wave generation system 104 such that they can be dropped or pressed into the water to generate waves in different directions. As examples, the plunger systems may include a laterally-actuated system 302, an angled plunger system 304, a vertically-actuated system 306, and a radially-actuated system 308. FIG. 5 illustrates schematic side views of the plunger systems 302, 304, 306, 308. Further, FIG. 5 also illustrates locations of each type of plunger system with respect to the wave generation mechanism 104 in a plan view of the wave pool 100 in accordance with present embodiments. Each of the plunger systems includes an actuator 310 and a plunger 312. The plungers 312 of the laterally- actuated system 302 and the angled plunger system 304 are plates with planar faces that serve as impact elements, whereas the plunger 312 for the vertically-actuated system 306 includes a neck 314 (e.g., a plate-like structure), and a beveled head 316, which may be elongate such that more water is impacted and longer waves are generated. The plunger 312 for the radially-actuated system 308 includes paddles that are rotated into the water to generate waves. The laterally-actuated system 302 moves in a lateral direction when actuated (as indicated by arrow 320), the angled plunger system 304 moves in a radial direction when actuated (as indicated by arrow 322), the vertically-actuated system 306 moves in a vertical direction when actuated (as indicated by arrow 324), and the radially-actuated system 308 rotates when actuated (as indicated by arrow 326). These different types of plunger systems may produce different types of waves and/or coordinate to generate a wave pattern. For example, a spiral wave that may be generated by coordinated actuation of the plunger systems 302, 304, 306, 308 is illustrated in FIG. 5.

In some embodiments, a plurality of different plungers (e.g., the plungers 312 of the laterally actuated plunger system 302 and the angled plunger system 304) may be coupled together by a flexible material. For example, a flexible/stretchable material (e.g., a rubber sheet) may extend between edges of the plungers 312 to provide contact with water in areas that the plungers 312 would not directly contact otherwise. For example, FIGS. 6 and 7 illustrate top views of a plurality of plunger systems 400 with an expandable sheet 402 (e.g., a rubber sheet) that couples plungers 404 of the plurality of plunger systems 400 together such that the expandable sheet 402 extends between edges of the plungers 404. Specifically, FIG. 6 illustrates the plunger systems 400 in an expanded condition 410, and FIG. 7 illustrates the plunger systems 400 in a contracted condition 408 to illustrate the action of the expandable sheet 402 during wave generation by the plunger systems 400 in accordance with present embodiments. In the expanded condition 410, waves are generated partly by the movement of the expandable sheet 402. While a single expandable sheet is illustrated, in some embodiments, multiple expandable sheets may be utilized such that the edges of the sheets couple with edges of the plungers 404. It should further be noted that, while FIGS. 6 and 7 show the plunger systems 400 being actuated simultaneously, in some embodiments, each of the plunger system 400 may be actuated at different times.

FIG. 8 illustrates a schematic cross-sectional view of the wave generation mechanism 104 including a water dump system 500 in accordance with present embodiments. In this embodiment, water is pumped into a tank 502 by the pumping system 144 and released by release mechanisms 504 (e.g., valves) into the wave pool 100. This dumping or ejecting may create wave actions in multiple directions by ejecting the water through directional features, such as release tubes 506 positioned around the wave generation mechanism 504 (e.g., in a circular arrangement). In some embodiments, the tank 502 may be pressurized with pumps 506 to increase the rate of release. Also, the tank 502 may be segmented to facilitate generation of waves with different timing and different characteristics in different directions.

In one embodiment, the tank 502 may include a tank wall 600 and a sealing mechanism 602, as illustrated in FIG. 9. The tank 502 may receive water from the pumping system 144 while the tank wall 600 is engaged with the sealing mechanism 602. When a sufficient amount of water has accumulated in the tank 502, the tank wall 600 may be lifted from engagement with the sealing mechanism 602 by an actuator 604, as represented by arrow 606, such that water is released in multiple directions from the break between the bottom of the tank wall 600 and the sealing mechanism 602. Once the water is released, the tank wall 600 may be lowered into engagement with the sealing mechanism 602 for filling of the tank 502 with water again. In some embodiments, water released in this manner may be guided via directional features (e.g., tubing, channels, or spouts) in multiple directions. Further, in some embodiments, the tank wall 600 may serve as a directional feature by varying in height such that water is released at different times from different sides when it is lifted. Likewise, the sealing mechanism 602 may vary in configuration to direct water flow differently when the tank wall 600 is lifted from engagement. Also, in some embodiments, the tank wall 600 may be lowered into a sheath-like sealing mechanism such that water accumulated in the tank 502 flows out from a top of the tank 502. In some embodiments, dumping systems such as the dumping system 500 may be incorporated into the wave generation mechanism 104 as one of various wave generating systems that combine to generate waves in multiple directions.

FIG. 10 illustrates a schematic cross-sectional view of yet another embodiment of the wave generation mechanism 104 in accordance with present embodiments. Specifically, the wave generation mechanism 104 illustrated in FIG. 10 includes an air blast system 700 configured to blast compressed air into the water of the wave pool 100 to generate waves in multiple directions. In operation, the air blast system 700 compresses air in an air tank 702 with an air compressor 704 and releases the compressed air periodically with release mechanisms 706 (e.g., valves) into tubing 708 that directs the compressed air into the water such that waves are generated. The tubing 708 includes spouts that are arranged around the wave generation mechanism. Systems such as the air blast system 700 may be combined with other systems to generate waves in accordance with present embodiments.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A wave pool, comprising:

a container configured to hold water and sufficiently sized to facilitate recreational activities for patrons therein;

a wave generation mechanism disposed at a location proximate a center of the container, wherein the wave generation mechanism is configured to generate waves that propagate in the water outward from the wave generation mechanism toward a perimeter of the container by displacing the water such that wave energy moves outward along a wave propagation path from the wave generation mechanism in multiple-directions, wherein the wave generation mechanism comprises a plunger system comprising a plurality of plungers that displace the water by being vertically inserted, pitched, or rolled into the water, and wherein each of the plurality of plungers is coupled one to another by a flexible sheet extending between edges of each of the plurality of plungers to increase contact with the water.

2. The wave pool of claim 1, wherein each of the plurality of plungers comprises a respective contact surface configured to displace the water in a different direction relative to other contact surfaces and away from the wave generation mechanism.

3. The wave pool of claim 1, wherein at least a portion of the container is deepest proximate the center of the container and gradually becomes more shallow toward the perimeter of the container until an area surrounding the container is reached that defines a shoreline for the wave pool.

4. The wave pool of claim 1, comprising at least a substantially 360 degree beach front around the container, wherein the wave generation mechanism is configured to generate waves that propagate outward toward the beach front.

5. The wave pool of claim 1, wherein the plurality of plungers comprises a plurality of displacement devices positioned in a polygonal arrangement such that each displacement device is configured to generate waves in a different direction.

6. The wave pool of claim 1, comprising a platform integrated with the wave generation mechanism and configured to support the park patrons or maintenance workers.

7. The wave pool of claim 1, comprising a porous barrier disposed at least substantially around the wave generation mechanism such that water can pass through the porous barrier and such that the patrons in an area of the container between the perimeter and the porous barrier are blocked from access to the wave generation mechanism.

8. The wave pool of claim 1, wherein each of the plurality of plungers is configured to be activated sequentially to generate a plurality of coalescent wave patterns, and wherein the plurality of coalescent wave patterns comprises a spiral wave formed around the wave generation mechanism.

9. The wave pool of claim 1, comprising transport features comprising piping disposed beneath or along a bottom of the container.

10. The wave pool of claim 9, wherein the transport features comprise a network of flow paths along the perimeter that feed at least one central transport feature configured to facilitate flow of the captured water to the wave generation mechanism.

11. The wave pool of claim 9, wherein the wave generation mechanism comprises a pumping system and collection reservoir, the pumping system configured to move the captured water received from the transport features into the collection reservoir.

12. The wave pool of claim 9, comprising a structure extending from the perimeter to the wave generation mechanism, wherein the structure houses one or more of the transport features that are configured to facilitate flow of the captured water to the wave generation mechanism.

13. A wave generation system, comprising:

a wave generation mechanism configured to be positioned centrally within a container filled with water that is sufficiently sized to facilitate recreational activities for patrons within the container, the wave generation mechanism comprising:

at least one actuator configured to activate at least one water-displacement medium to displace the water such that waves are propagated through the water;

a directional feature configured to direct the waves away from the wave generation mechanism after activation of the actuator such that the waves are propagated outward along a wave propagation path from the wave generation mechanism in multiple directions; and a plunger system comprising a plurality of plungers that displace the water by being vertically inserted, pitched, or rolled into the water, wherein each of the plurality of plungers is coupled one to another by a flexible sheet extending between edges of each of the plurality of plungers.

14. The wave generation system of claim 13, wherein the directional feature comprises surface features of the plurality of plungers.

15. The wave generation system of claim 14, wherein the surface features are configured to impact the water non-uniformly.

16. The wave generation system of claim 13, wherein the actuator comprises a release mechanism configured to raise or lower a portion of a containment feature such that accumulated water disposed within the containment feature is released to flow out of the containment feature in multiple directions.

17. The wave generation system of claim 16, wherein the portion of the containment feature comprises a generally cylindrical wall that is configured to couple with a seal at a base of the generally cylindrical wall.

18. The wave pool of claim 1, wherein a water capture drain is located in a channel around the perimeter of the container, and wherein the channel is configured to direct water toward the water capture drain.

19. The wave pool of claim 1, comprising:

a water capture system configured to cycle the water from the direction of the perimeter of the container back toward the direction of the wave generation mechanism, wherein the water capture system comprises:

a water capture drain configured to capture the water, wherein the water capture drain is located at an outer edge of the container along the wave propagation path to reduce a possible occurrence of interference between the waves generated by the wave generation mechanism and waves reflected by one or more perimeter walls of the container; and a transport feature configured to receive the captured water from the water capture drain and to facilitate flow of the captured water to the wave generation mechanism.

20. The wave generation system of claim 13, comprising:

a water capture system configured to cycle water to the wave generation mechanism from perimeter locations within the container back toward the direction of the wave generation mechanism, wherein the water capture system comprises:

water capture drains positioned at an outer edge of the container along the wave propagation path to reduce a possible occurrence of interference between the waves generated by the wave generation mechanism and waves reflected by one or more perimeter walls of the container, wherein the water capture drains are configured to capture the water; and transport features configured to receive the captured water from the water capture drains and to facilitate flow of the captured water to the wave generation mechanism.

* * * * *